US011174684B2

(12) United States Patent
Kabiraj et al.

(10) Patent No.: US 11,174,684 B2
(45) Date of Patent: Nov. 16, 2021

(54) FLUSHING SYSTEM IN DRILL BITS

(71) Applicant: Caterpillar Global Mining Equipment LLC, Denison, TX (US)

(72) Inventors: Koushik Kabiraj, Ranchi (IN); Akshay Deepak Mate, Pune (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 22 days.

(21) Appl. No.: 16/801,146

(22) Filed: Feb. 26, 2020

(65) Prior Publication Data

US 2021/0262294 A1 Aug. 26, 2021

(51) Int. Cl.

| | |
|---|---|
| ***E21B 10/38*** | (2006.01) |
| ***E21B 10/61*** | (2006.01) |
| ***E21B 10/36*** | (2006.01) |
| *E21B 6/00* | (2006.01) |

(52) U.S. Cl.

CPC ..... *E21B 10/38* (2013.01); *E21B 10/36* (2013.01); *E21B 10/61* (2013.01); *E21B 6/00* (2013.01)

(58) Field of Classification Search

CPC ..... E21B 10/38; E21B 10/56; E21B 10/36; E21B 10/567; E21B 10/60; E21B 10/61; E21B 6/00; E21B 10/26

See application file for complete search history.

(56) References Cited

U.S. PATENT DOCUMENTS

| | | | | |
|---|---|---|---|---|
| 4,819,746 | A | 4/1989 | Brown | |
| 5,025,875 | A * | 6/1991 | Witt | E21B 10/56 175/393 |
| 6,073,711 | A * | 6/2000 | Ingmarsson | E21B 10/56 175/420.2 |
| 7,467,674 | B2 | 12/2008 | Green | |
| 2010/0108398 | A1 | 5/2010 | Niu | |

FOREIGN PATENT DOCUMENTS

| | | | |
|---|---|---|---|
| CN | 100354498 | C | 12/2007 |
| DE | 102004034763 | A1 | 3/2006 |
| WO | 9015220 | W | 12/1990 |
| WO | 201241084 | W | 4/2012 |
| WO | 2012174607 | A1 | 12/2012 |

* cited by examiner

*Primary Examiner* — Yong-Suk (Philip) Ro

(57) ABSTRACT

A flushing system in a drill bit, which has a body that defines the flushing system, can include an inlet to facilitate supply of pressurized fluids into a bore hole. A cutting surface of the drill bit is provided with a main opening that defines a main passageway in communication with the inlet. A peripheral surface of the drill bit is provided with a secondary opening that defines a secondary passageway in communication with the inlet. The secondary passageway is disposed at an angle from a horizontal reference plane. The horizontal reference plane is defined between the inlet and the origin of the main passageway and is perpendicular to a central longitudinal axis of the body of the drill bit. An origin of the secondary passageway is at a distance from the origin of the main passageway.

18 Claims, 11 Drawing Sheets

FLUSHING SYSTEM IN DRILL BITS

TECHNICAL FIELD

The present disclosure relates to drill bits applicable in drilling operations. More particularly, the present disclosure relates to a flushing system in drill bits that facilitates better rate of penetration of the drill bit and also increases total lifespan of the drill bit.

BACKGROUND

Industrial drilling devices such as a "Down-The-Hole" (DTH) drill, have been typically employed in drilling relatively large diameter holes in surface-drilling applications. Heavy industries such as blast-hole mining, water well drilling, oil and gas, and construction work, employ the DTH drill for its ease of use and flexibility to drill aligned and accurately placed bore holes in a variety of rock conditions. A DTH drill, typically comprises a DTH hammer located directly behind a drill bit and drill pipes that transmit feed force and rotation to the DTH hammer and the drill bit. The drill pipes also supply compressed air or fluids for operating the DTH hammer and flushing of cut matter from the bore hole.

In recent times, the drill bit used in the DTH drill is provided with inserts (e.g., tungsten carbide inserts) on a cutting surface of the drill bit. The drill bit with the inserts is also commonly referred to as a button drill bit. The button drill bit also includes flushing holes to supply compressed air into the bore hole and facilitate removal of debris and/or cut matter from the bore hole to an outlet generally via an annular space around the drill bit.

Button drill bits with two flushing holes, for example, are known to endure excessive steel erosion on a cutting surface of the button drill bits as a result of the debris and/or the cut matter scraping against the cutting surface during operation. The excessive steel erosion causes the inserts to become exposed and weaken over time and thereby, reduces a total lifespan of the button drill bit. Button drill bits with two flushing holes are also known to have problems associated with poor air circulation around the cutting surface of the button drill bits and thereby, resulting in "secondary grinding" inside the bore hole. The secondary grinding refers to cutting of the already cut matter inside the bore hole as a result of the poor air circulation.

Button drill bits with three flushing holes, for example, have been used to provide better air circulation around the cutting surface of the button drill bits and thereby, achieve better flushing of debris and/or cut matter from the bore hole than the button drill bits with two flushing holes. However, the total surface area available for the inserts on the cutting surface of the button drill bits with the three flushing holes is comparatively lesser than total surface area available for the inserts on the cutting surface of the button drill bits with the two flushing holes. As a result, the button drill bits with the three flushing holes tend to have a lesser number of the inserts on the cutting surface in comparison with the button drill bits with the two flushing holes. The lesser number of inserts on the cutting surface of the button drill bits eventually reduces a rate of penetration of the button drill bits inside the bore hole and also reduces the total lifespan of the button drill bits.

U.S. Pat. No. 7,467,674 relates to a drill bit for a reverse circulation rock drill or down-the-hole hammer assembly. The drill bit includes inclined passages in the drill bit head and an axially extending central tube for recovery of drilling debris.

SUMMARY OF THE INVENTION

In an aspect of the disclosure, a drill bit comprising a body that is adapted to flush cut matter from a bore hole is disclosed. The body defines a flushing system that includes an inlet, a cutting surface provided with at least one main opening that is in communication with the inlet, and a peripheral surface, surrounding the cutting surface, provided with at least one secondary opening that is in communication with the inlet. The inlet facilitates supply of pressurized fluids to flush the cut matter from the bore hole. The main opening in the cutting surface allows passing of the pressurized fluids from the inlet to the bore hole and defines a main passageway originating from the inlet to the cutting surface. The secondary opening in the peripheral surface allows passing of the pressurized fluids from the inlet to the bore hole and defines a secondary passageway originating from the inlet to the peripheral surface. The secondary passageway is disposed at an angle with respect to a horizontal reference plane. The horizontal reference plane is defined between the inlet and the origin of the main passageway and is perpendicular to a central longitudinal axis of the body of the drill bit. The origin of the secondary passageway from the inlet is positioned at a distance from the horizontal reference plane.

In yet another aspect of the disclosure, a method for configuring a drill bit to flush cut matter from a bore hole is disclosed. The method includes providing an inlet in a body of the drill bit to facilitate supply of pressurized fluids to the bore hole. The method also includes providing at least one main opening in a cutting surface that is in communication with the inlet. The main opening provided in the cutting surface defines a main passageway originating from the inlet to the cutting surface. Further, the method includes providing at least one secondary opening in a peripheral surface surrounding the cutting surface that is in communication with the inlet. The secondary opening provided in the peripheral surface defines a secondary passageway originating from the inlet to the peripheral surface. The secondary passageway is disposed at an angle with respect to a horizontal reference plane. The horizontal reference plane is defined between the inlet and the origin of the main passageway and is perpendicular to a central longitudinal axis of the body of the drill bit. The origin of the secondary passageway from the inlet being positioned at a distance from the horizontal reference plane. Furthermore, the method includes determining a diameter of the drill bit, determining velocity of the pressurized fluids through the secondary opening, and determining a pressure differential between a pressure of the pressurized fluids air around the cutting face relative to a pressure of the pressurized fluids at the inlet. In addition, the method also includes reconfiguring the secondary opening based on the diameter of the drill bit, the velocity and the pressure differential determined.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

Figure 1:
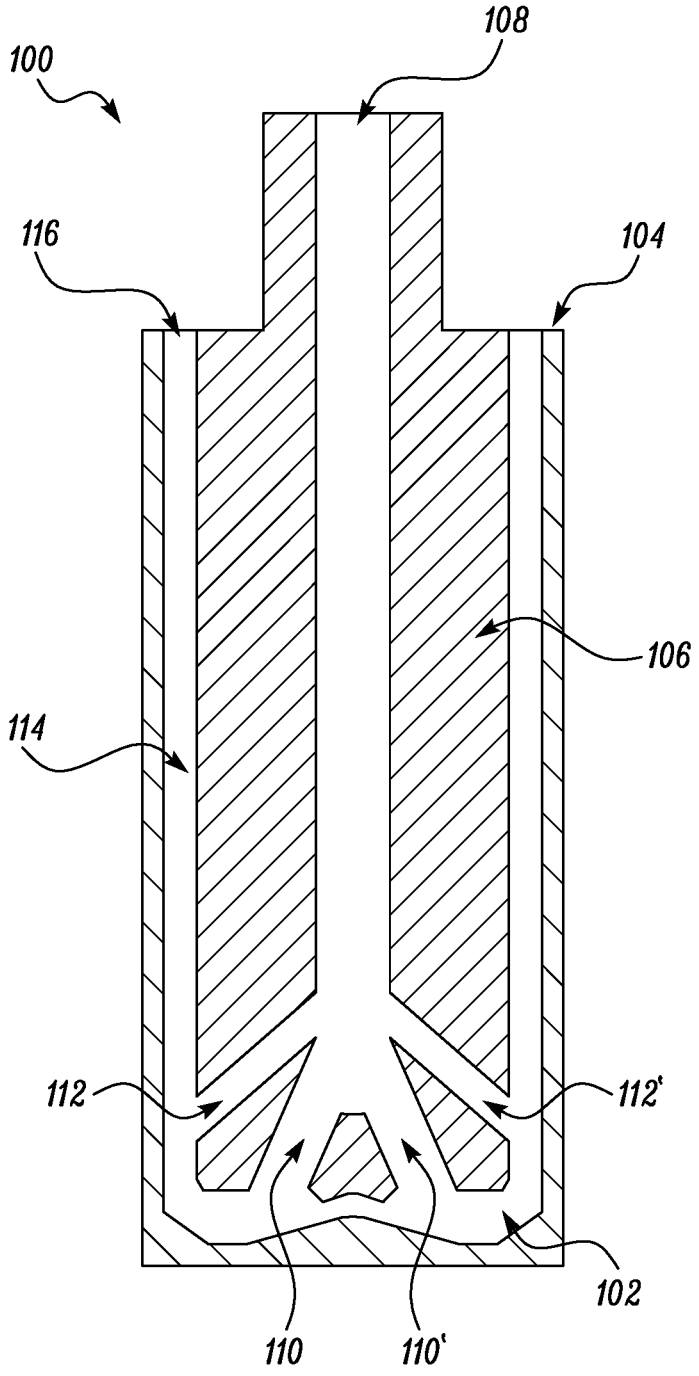
FIG. 1 is cross-sectional view of a drill bit in a blast hole mining environment, in accordance with an embodiment of the present disclosure.

Referring to FIG. 1, a cross-sectional view of a drill bit 100 in a blast hole mining environment is illustrated. The drill bit 100 may be a "Down-the-Hole" (DTH) drill bit attached to a DTH hammer (not shown) and connected to a drill pipe (not shown). The drill bit 100 may subject to both rotary and linear downward movement during operation by means of the DTH hammer. The DTH hammer may be hydraulically or pneumatically operated. The drill pipes (not shown) connected to the DTH hammer and an inlet 108 of the drill bit 100 may supply the pressurized fluids needed for the operation. Different types of the drill bit 100 may be employed depending on a work environment in a related industry such as blast-hole mining, water well drilling, oil and gas, and construction work. In the blast-hole mining industry the different types of the drill bit 100 may also be employed based on rock conditions or rock mass properties in the work environment. Examples of the different types of the drill bit 100 include, but are not limited to, a milled-tooth bit, a tungsten carbide insert (TCI) or insert bit, a fixed cutter bit such as polycrystalline diamond cutter (PDC) and natural synthetic diamond cutter, and so forth.

The drill bit 100 defines a body 106 that is adapted to cut and drill through a work surface 104 and form a bore hole 102. The body 106 includes the inlet 108, two main openings 110, 110', and two secondary openings 112, 112'. The inlet 108 facilitates supply of pressurized fluids into the bore hole 102 via the two main openings 110, 110' and the two secondary openings 112, 112' in order to flush cut matter from the bore hole 102. The pressurized fluids may be hydraulic fluids or compressed air having inherent velocity and pressure. During operation, the pressurized fluids may be continuously supplied at the inlet 108 and allowed to enter the bore hole 102 via the two main openings 110, 110' and the two secondary openings 112, 112'. Pressure from the pressurized fluids exiting from the two main openings 110, 110', and the two secondary openings 112, and 112' forces freshly cut matter from a bottom of the bore hole 102 to pass through an annular space 114 around the drill bit 100 and exit through to an outlet 116 that is level with the work surface 104.

Figure 2:
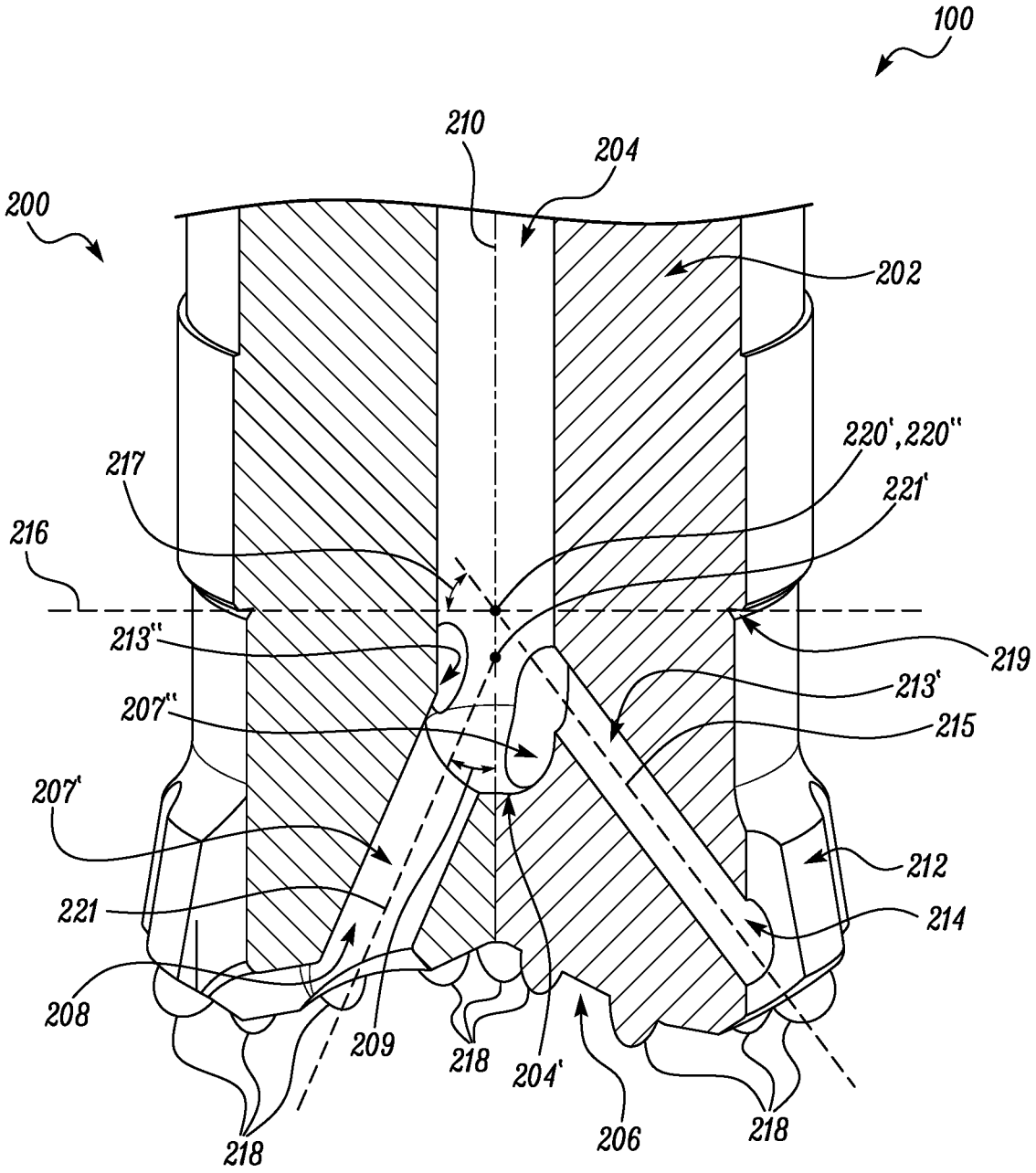
FIG. 2 is a cross-sectional view of a flushing system in the drill bit of FIG. 1, in accordance with the embodiment of the present disclosure.

Referring to FIG. 2, a cross-sectional view of a flushing system 200 in the drill bit 100 of FIG. 1. The drill bit 100 includes a body 202 that is adapted to flush cut matter from the bore hole 102 (as shown in FIG. 1). The body 202 defines the flushing system 200 that includes an inlet 204 to facilitate supply of pressurized fluids to flush the cut matter from the bore hole 102. The inlet 204 may be cylindrical and hollow along a length of the drill bit 100.

Figure 3:
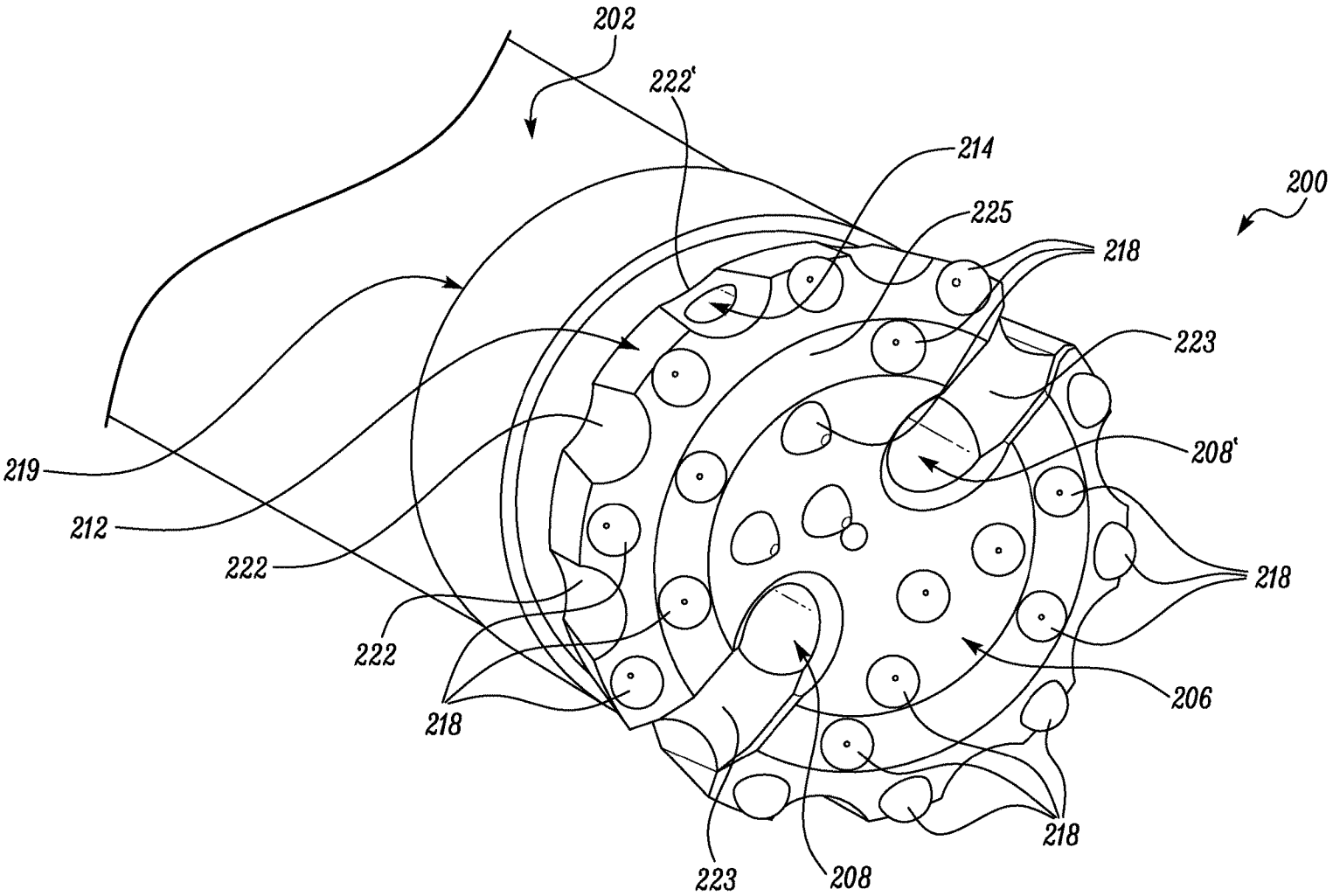
FIGS. 3-4 illustrate perspective views of the drill bit of FIG. 1 having a flushing system of FIG. 2, in accordance with the embodiment of the disclosure.
Figure 4:
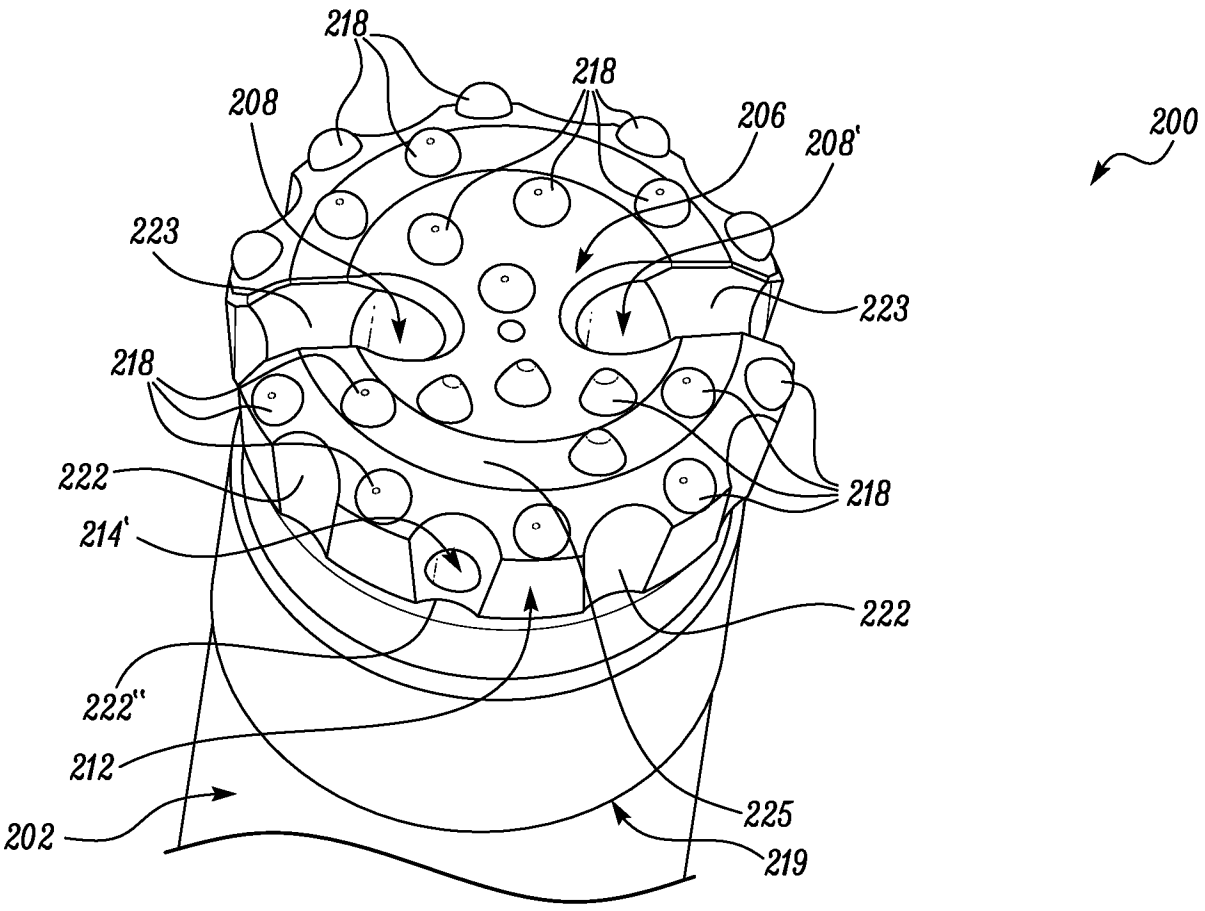

The flushing system 200 further includes a cutting surface 206 that is provided with at least one main opening 208 (also see FIGS. 3-4). Although not limited, the cutting surface 206 may be perpendicular to a central longitudinal axis 210 of the body 202. In some embodiments, the cutting surface 206 of the drill bit 100 may be provided with a plurality of inserts 218 (also see FIGS. 3 and 4) to dig and cut through the bore hole 102. The inserts 218 may be made of one or more materials including, but not limited to, tungsten carbide, titanium carbide, and/or tantalum carbide. The main opening 208 is in communication with the inlet 204 such that the main opening 208 allows passing of the pressurized fluids from the inlet 204 to a bottom of the bore hole 102. The main opening 208 defines a main passageway 207' originating from the inlet 204 to the cutting surface 206. An intersection of a central longitudinal axis 221 of the main passageway 207' with the central longitudinal axis 210 of the body 202 defines the origin 221' of the main passageway 207'. In some embodiments, the inlet 204 may define a recess 204' having one of a hemispherical shape, a semi-elliptical shape, a flanged shape, a dished shape, a conical shape, and a flat shape at the origin 221' of the at least one main passageway 207'.

The flushing system 200, in addition, includes a peripheral surface 212, surrounding the cutting surface 206, that is provided with at least one secondary opening 214. Although not limited, the peripheral surface 212 may be parallel to the central longitudinal axis 210 of the drill bit 100. The secondary opening 214 is in communication with the inlet 204 such that the secondary opening 214 also allows passing of the pressurized fluids from the inlet 204 to the bottom of the bore hole 102. The secondary opening 214 defines a secondary passageway 213' originating from the inlet 204 to the peripheral surface 212. The secondary passageway 213' is disposed at an angle 217 with respect to a horizontal reference plane 216. The angle 217 of the secondary passageway 213' with respect to the horizontal reference plane 216 may range from 37 degrees to 43 degrees. The horizontal reference plane 216 is defined between the inlet 204 and the origin 221' of the main passageway 207' and is perpendicular to the central longitudinal axis 210 of the body 202. An intersection of the central longitudinal axis 210 and the horizontal reference plane 216 defines a reference point 220'. In some embodiments, the horizontal reference plane 216 may be defined at an outer neck surface 219 on the body 202 of the drill bit 100. The outer neck surface 219 may a flat circumferential surface that may be perpendicular to the central longitudinal axis 210 of the body 202 of the drill bit 100. In some embodiments, the horizontal reference plane 216 may also be define at the intersection of the central longitudinal axis 221 of the main passageway 207' with the central longitudinal axis 210 of the body 202.

The angle 217 of the secondary passageway 213' and a diameter of the secondary passageway 213' may be determined by evaluating one or more factors. The factors include, but are not limited to, a diameter of the drill bit 100, velocity of the pressurized fluids passing through the secondary opening 214, and a pressure differential between pressure of the pressurized fluids measured at the inlet 204 and pressure of the pressurized fluids measured around the cutting surface 206 of the drill bit 100. For example, the angle 217 of the secondary passageway 213' may need to be increased above 43 degrees and/or decreased below 37 degrees for different diameters of the drill bit 100. Further, the diameter of the secondary passageway 213' may need to be altered in order to moderate the velocity of the pressurized fluids. Also, the diameter of the secondary passageway 213' may need to be altered in order to moderate the pressure differential.

An intersection of a central longitudinal axis 215 of the secondary passageway 213' with the central longitudinal axis 210 of the body 202 defines the origin 220" of the secondary passageway 213'. The origin 220" of the secondary passageway may be at a distance (see FIGS. 8-10) from the horizontal reference plane 216. In one embodiment, the origin 220" of the secondary passageway 213' may coincide with the reference point 220', as shown in FIG. 1, (also see FIG. 7) on the horizontal reference plane 216. Consequently, the distance of the origin 220" of the secondary passageway 213' from the horizontal reference plane may be zero. In another embodiment of the present disclosure, the reference point 220' on the horizontal reference plane 216 may precede the origin 220" of the secondary passageway 213' from the inlet 204 by a distance 228, 232 (see FIGS. 8 and 9). Accordingly, the origin 220" of the secondary passageway 213' may be positioned at the distance 228, 232 from the horizontal reference plane 216 respectively. The distance 228, 232 may range from 2 mm to 10 mm. In yet another embodiment, the origin 220" of the secondary passageway 213' may precede the reference point 220' from the inlet 204 by a distance 236 (see FIG. 10). Accordingly, the origin 220" of the secondary passageway 213' is positioned at the distance 236 from the horizontal reference plane 216. The distance 236 may range from 0 mm to 5 mm.

In some embodiments, the cutting surface 206 of the drill bit 100 is provided with an additional main opening 208' (see FIGS. 3 and 4). The main opening 208 and the additional main opening 208' independently define two main passageways 207' and 207" (also see FIG. 5) originating from the inlet 204. The two main passageways 207' and 207" are disposed at an angle 209 from the central longitudinal axis 210 of the drill bit 100. The two main passageways 207' and 207" may be co-incident at the origin 221' of the main passageway 207'.

The peripheral surface 212 may also be provided with an additional secondary opening 214' (see FIG. 4). The secondary opening 214 and the additional secondary opening 214' may independently define two secondary passageways 213' and 213" (also see FIG. 5) originating from the inlet 204. In some embodiments, an origin 220'" of the secondary passageway 213" may be co-incident with the origin 220' of the secondary passageways 213'. Accordingly, a central longitudinal axis 215 of the secondary passageway 213' and a central longitudinal axis (not shown) of the additional secondary passageway 213" may intersect with the central longitudinal axis 210 of the body 22 at the origins 220", 220'" of the two secondary passageways 213', 213" respectively. The two secondary openings 214, 214' may be disposed at corresponding angles, for example, the angle 217 from the horizontal reference plane 216. According to one aspect of the present disclosure, the two secondary passageways 213', 213" may be diametrically similar. In another aspect of the present disclosure, the two secondary passageways 213', 213" may be diametrically dissimilar.

According to one aspect of the present disclosure, a position of the secondary opening 214 and/or the additional secondary opening 214' on the peripheral surface 212 is determined by a position of the inserts 218 such that none of the inserts 218 are in direct communication with the pressurized fluids exiting from the secondary opening 214 and/or the additional secondary opening 214'. Accordingly, no insert 218 is positioned in a region 225 that is immediately in front of the secondary opening 214 and/or the additional secondary opening 214'.

Further to the embodiments disclosed herein, different variations and implementations of the two secondary openings 214, 214' on the peripheral surface 212 may be contemplated. For example, the peripheral surface 212 may be provided with multiple secondary openings and hence, multiple secondary passageways disposed at different angles from the horizontal reference plane 216. Similarly, the cutting surface 206 may be provided with multiple main openings and hence, multiple main passageways disposed at different angles from the central longitudinal axis 210 of the drill bit 100. Positions of the inserts 218 may also be manipulated with respect to positions of the multiple secondary passageways such that none of the inserts 218 are provided in the region 225 immediately in front of the multiple secondary passageways respectively. Multiple secondary passageways with similar and/or dissimilar diameters may also be provided. In some embodiments, a total of circumferential areas of the two main openings 208, 208' and circumferential areas of the two secondary openings 214, 214' respectively may be equivalent to a total of circumferential areas of three main openings and no secondary opening respectively.

Referring to FIG. 3 and FIG. 4, perspective views of the drill bit 100 of FIG. 1 having the flushing system 200 of FIG. 2 is disclosed. In some embodiments, the peripheral surface 212 of the drill bit 100 may include a plurality of longitudinal slots 222 along a circumference of the peripheral surface 212. The two main openings 208, 208' may extend to grooves 223 on the cutting surface 206 and the grooves 223 may further extend to the longitudinal slots 222. In an exemplary implementation, the secondary opening 214 and/or the additional secondary opening 214' may be provided in the longitudinal slots 222' and 222" respectively.

INDUSTRIAL APPLICABILITY

During operation (see FIG. 5) of the drill bit 100 of FIG. 1 having the flushing system 200 of FIG. 2, the pressurized fluids is supplied to the inlet 204. The pressurized fluids from the inlet 204 pass through main passageways 207' and 207" and exit via the two main openings 208, 208' on the cutting surface 206 of the drill bit 100. Simultaneously, the pressurized fluids from the inlet 204 pass through the secondary passageways 213' and 213" and exit via the two secondary openings 214, 214' on the peripheral surface 212 of the drill bit 100. The pressurized fluids exiting from the two main openings 208, 208' and the two secondary openings 214, 214' removes cut matter from the bottom of the bore hole 102 (as show in FIG. 1) to an outlet 116 (as shown in FIG. 1).

Figure 5:
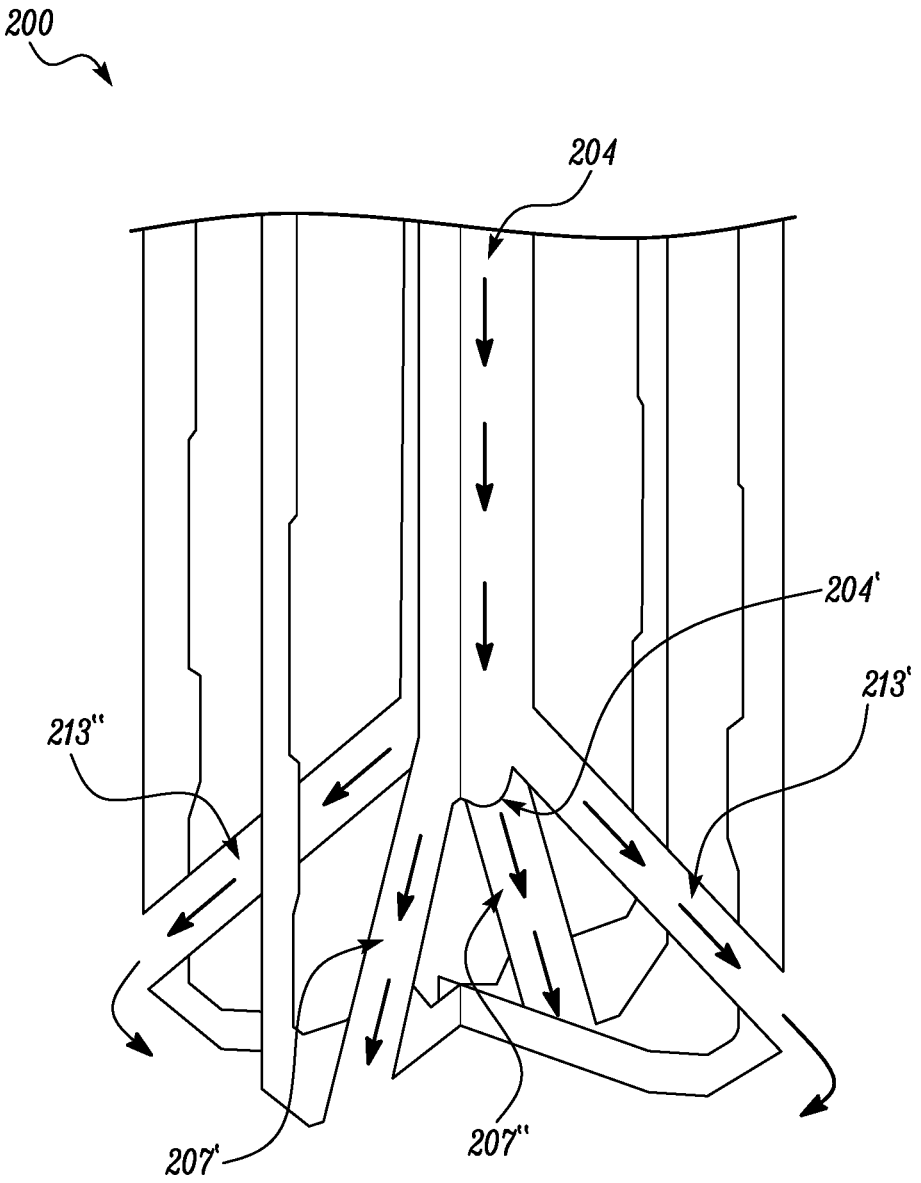
FIG. 5 schematically illustrates a direction of flow of pressurized fluids in the flushing system of FIG. 2, in accordance with the embodiment of the present disclosure.
Figure 6:
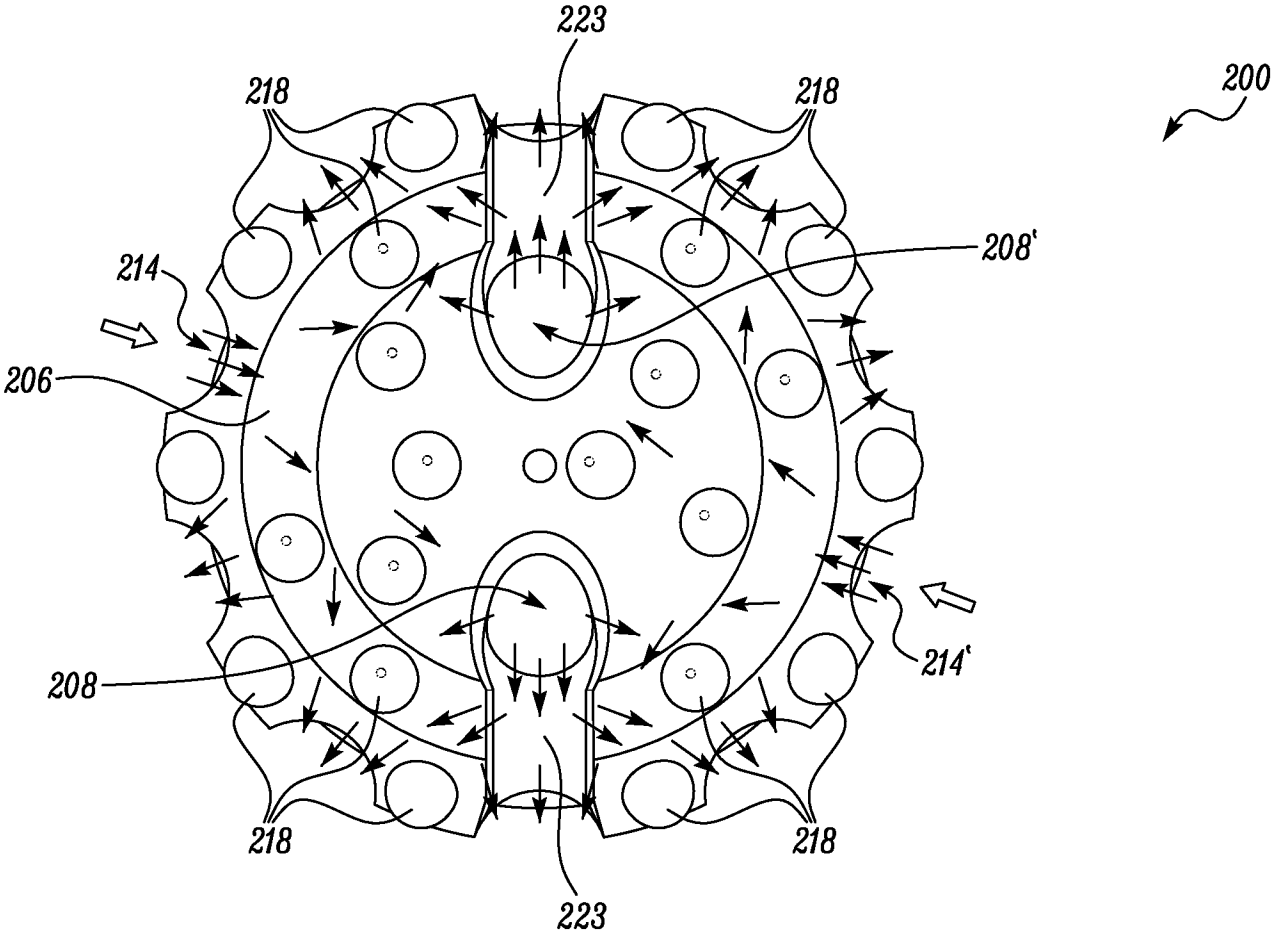
FIG. 6 schematically illustrates fluid movement around a cutting surface of the drill bit of FIG. 1 having a flushing system of FIG. 2, in accordance with the embodiment of the present disclosure.

Corresponding to the pressurized fluids exiting the two main openings 208, 208' and the two secondary openings 214, 214' as shown in FIG. 5, a uniform fluid movement around the cutting surface 206 of the drill bit 100 may be achieved (see FIG. 6). The uniform fluid movement facilitates better flushing or removal of the cut matter from the bore hole 102, better rate of penetration of the drill bit 100 in the bore hole 102, and improves a total lifespan of the drill bit 100.

The secondary passageway 213' and/or the additional secondary passageway 213" in the drill bit 100 having the flushing system 200 of FIG. 2 may be positioned at different angles and at different distances from the horizontal reference plane 216.

Figure 7:
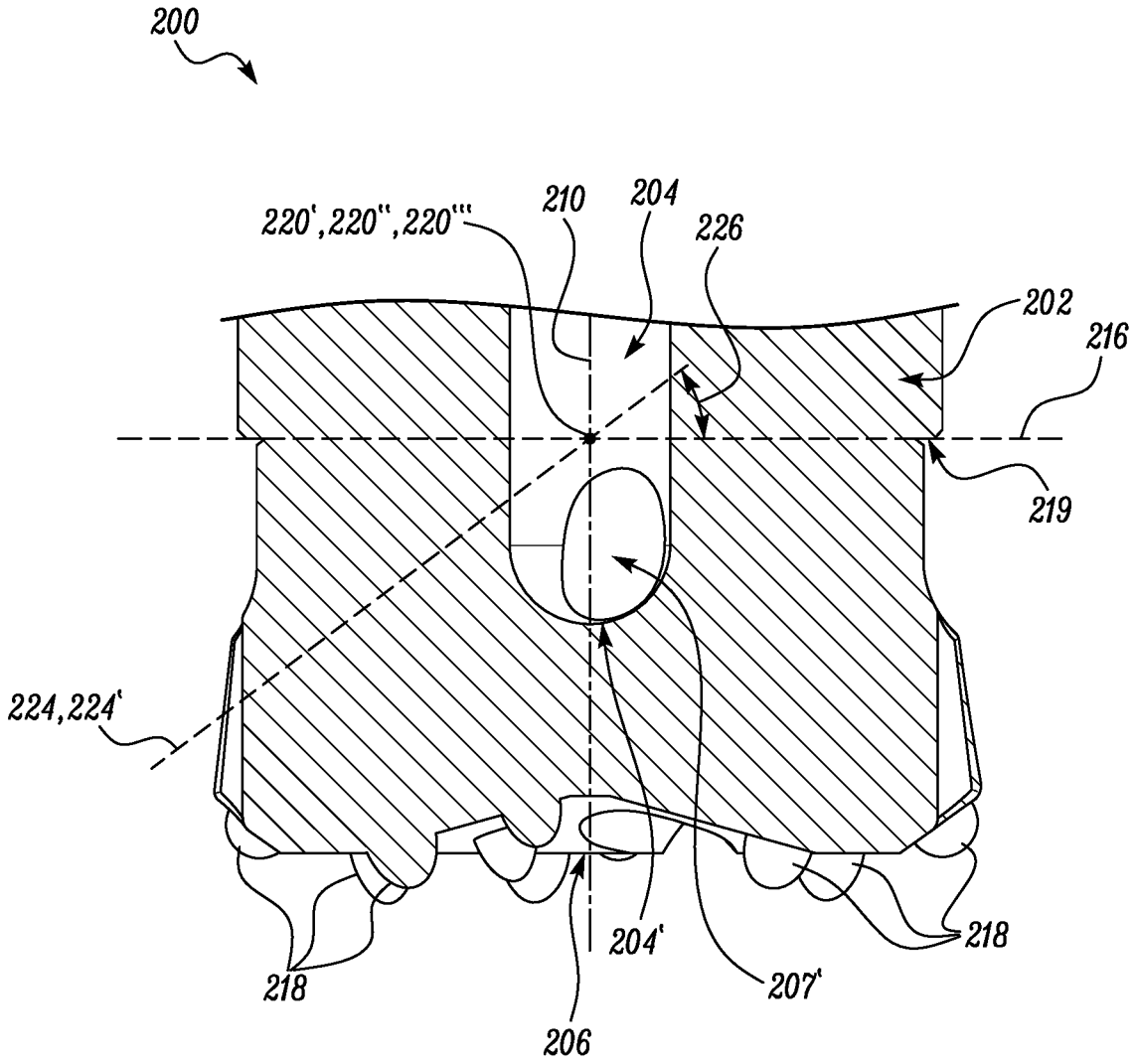
FIGS. 7-10 illustrate various positions of a secondary passageway in the drill bit of FIG. 1 having a flushing system of FIG. 2, in accordance with the embodiment of the present disclosure.

For example, referring to FIG. 7, a central longitudinal axis 224 of the secondary passageway 213' and/or a central longitudinal axis 224' of the additional secondary passageway 213" (as shown in FIG. 4-5) respectively may be inclined at an angle 226 from the horizontal reference plane 216. The angle 226 may be 37 degrees. The origin 220" of the secondary passageway 213' and/or the origin 220'" of the additional secondary passageway 213" may coincide with the reference point 220' on horizontal reference plane 216.

Figure 8:
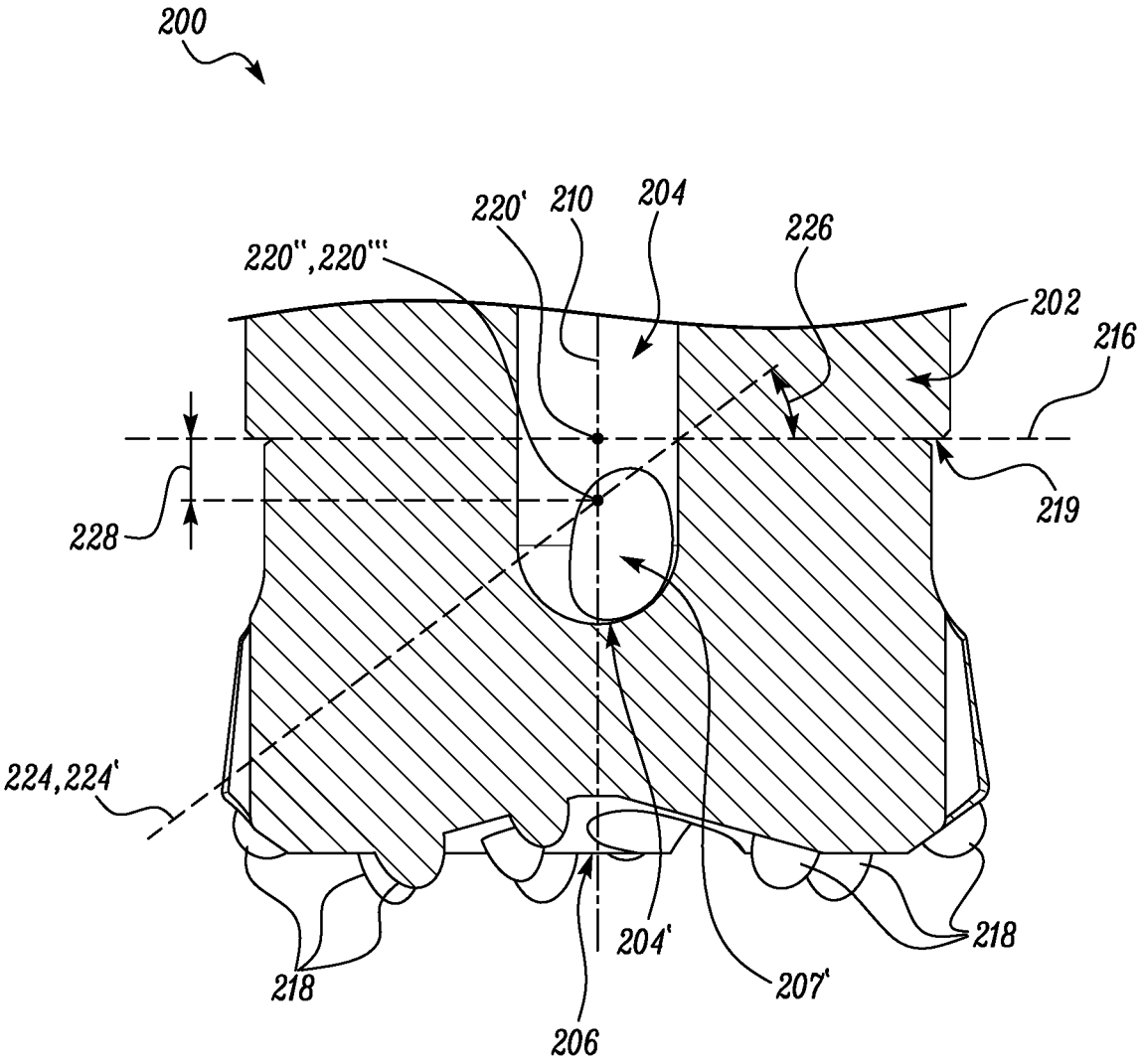

In another example, referring to FIG. 8, the central longitudinal axis 224 of the secondary passageway 213' and/or the central longitudinal axis 224' of the additional secondary passageway 213" may be inclined at an angle 226 from the horizontal reference plane 216. The angle 226 may be 37 degrees. The reference point 220' on the horizontal reference plane 216 may precede the origin 220" of the secondary passageway 213' and/or the origin 220'" of the additional secondary passageway 213" from the inlet 204. The origin 220" of the secondary passageway 213' and/or the origin 220'" the additional secondary passageway 213" may be at a distance 228 from the horizontal reference plane 216. The distance 228 may be 10 mm.

Figure 9:
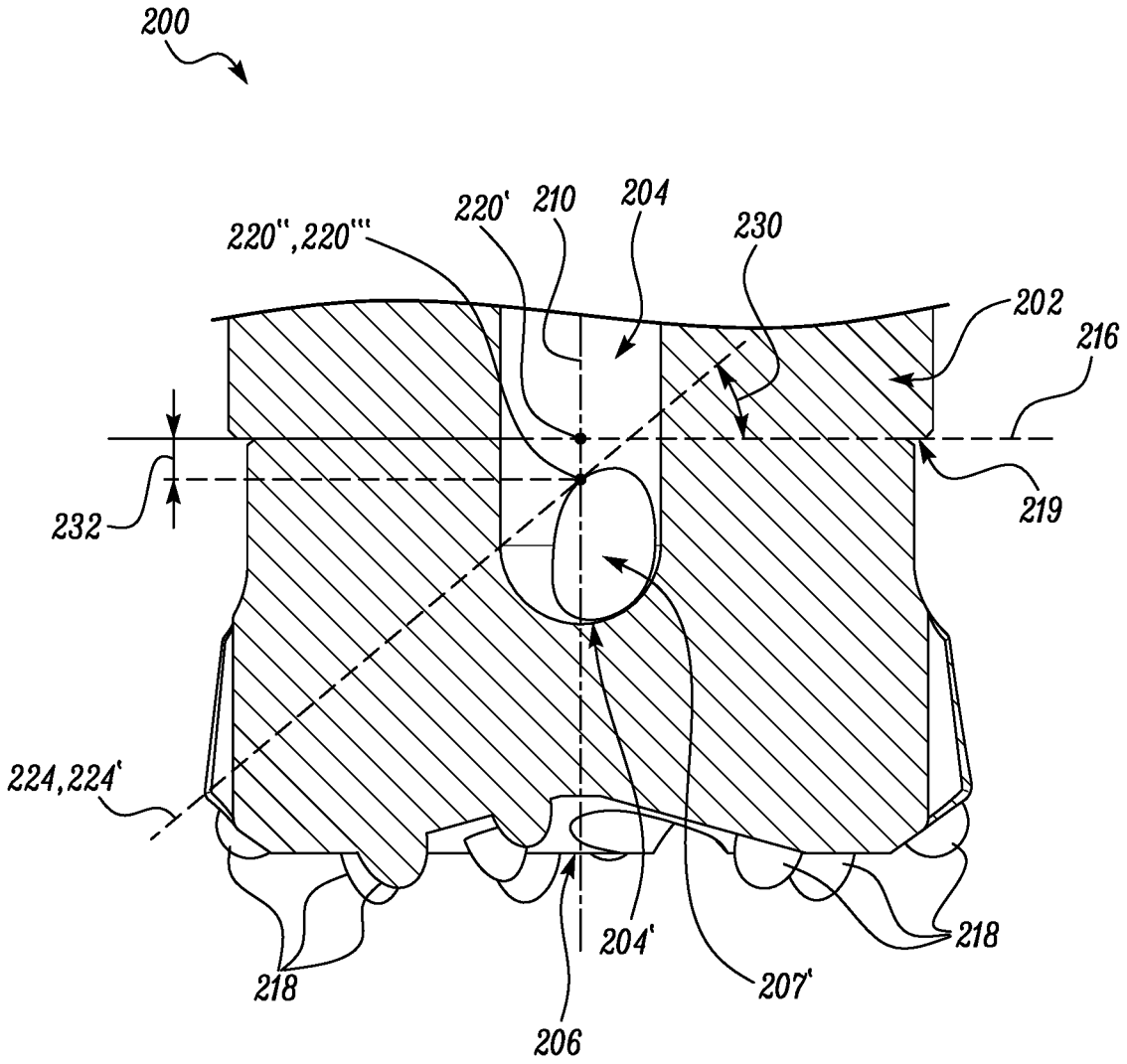

In yet another example, referring to FIG. 9, the central longitudinal axis 224 of the secondary passageway 213' and/or the central longitudinal axis 224' of the additional secondary passageway 213" may be inclined at an angle 230 from the horizontal reference plane 216. The angle 230 may be 40 degrees. The reference point 220' on the horizontal reference plane 216 may precede the origin 220" of the secondary passageway 213' and/or the origin 220'" of the additional secondary passageway 213" from the inlet 204. The origin 220" of the secondary passageway 213' and/or the origin 220'" of the additional secondary passageway 213" may be at a distance 232 from the horizontal reference plane 216. The distance 232 may be 2 mm.

Figure 10:
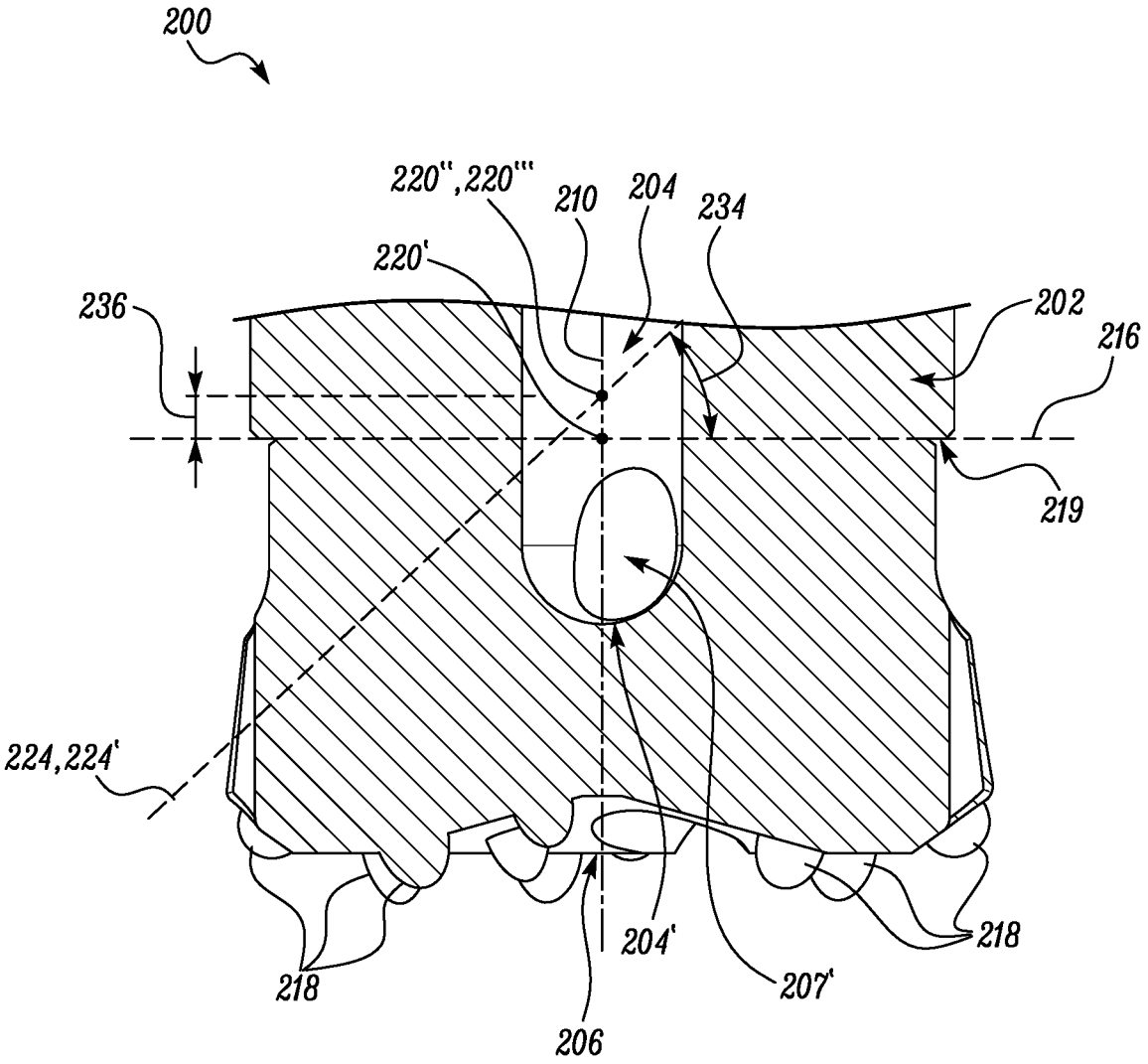

In another example, referring to FIG. 10, the central longitudinal axis 224 of the secondary passageway 213' and/or the central longitudinal axis 224' of the additional secondary passageway 213" (as shown in FIG. 4) may be inclined at an angle 234 from the horizontal reference plane 216. The angle 234 may be 43 degrees. The origin 220" of the secondary passageway 213' and/or the origin 220'" of the additional secondary passageway 213" may precede the reference point 220' from the inlet 204. The origin 220" of the secondary passageway 213' and/or the origin 220'" of the additional secondary passageway 213" may be at a distance 236 from the horizontal reference plane 216. The distance 236 may be 5 mm.

Accordingly, maintaining the angle of the secondary passageway 213' and/or the additional secondary passageway 213" at 43 degrees and the distance of the secondary passageway 213' and/or the additional secondary passageway 213" at 5 mm is empirically determined to improve an overall efficiency of the drill bit 100. The overall efficiency of the drill bit 100 may be defined by the rate of penetration of the drill bit 100 through the bore hole 102 and the total lifespan of the drill bit 100.

Figure 11:
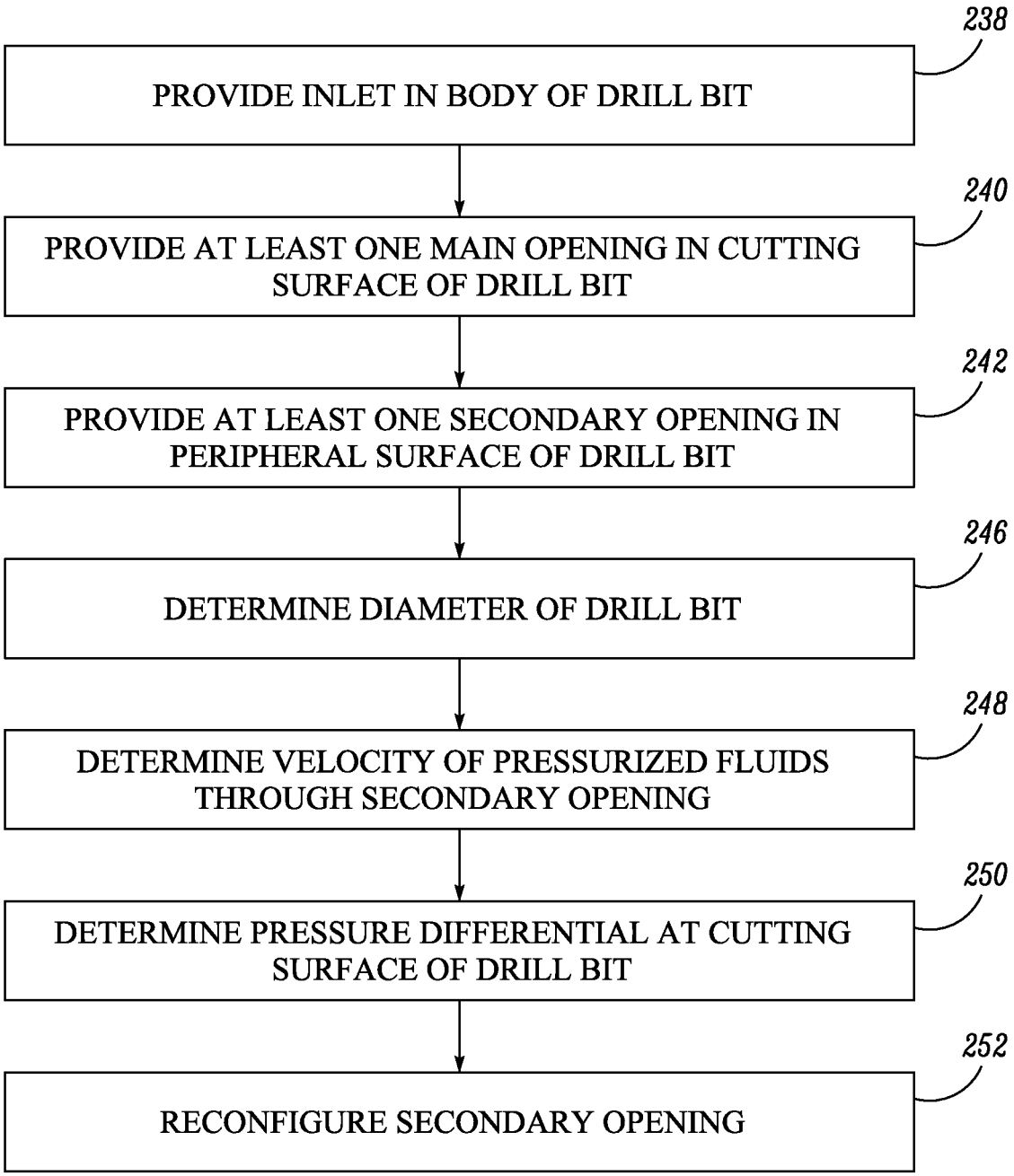
FIG. 11 is an exemplary illustration of a method for configuring the drill bit of FIG. 1 to flush cut matter from a bore hole, in accordance with the embodiment of the present disclosure.

The drill bit 100 may also be configured by means of a method in a digital simulation environment. For example, referring to FIG. 11, the method for configuring the drill bit 100 of FIG. 1 to flush cut matter from the bore hole 102 is disclosed. The method includes a step 238 of providing the inlet 204 in the body 202 of the drill bit 100 to facilitate supply of pressurized fluids to the bore hole 102. Further, the method includes a step 250 of providing at least one main opening 208 in the cutting surface 206 that is in communication with the inlet 204. The main opening 208 defines the main passageway 207' originating from the inlet 204 of the drill bit 100 to the cutting surface 206. In some embodiments, the intersection of the central longitudinal axis 210 of the drill bit 100 and the central longitudinal axis 221 of the main passageway 207' defines the origin 221' of the main passageway 207'.

The method also includes a step 242 of providing at least one secondary opening 214, in the peripheral surface 212 surrounding the cutting surface 206, that is in communication with the inlet 204. The secondary opening 214 defines the secondary passageway 213' originating from the inlet 204 to the peripheral surface 212. The secondary passageway 213' may also be disposed at the angle 217, 226, 230, 234 (see FIG. 1 and FIGS. 7-10) with respect to the horizontal reference plane 216. The horizontal reference plane 216 is defined between the inlet 204 and the origin 221' of the main passageway 207' and is perpendicular to a central longitudinal axis 210 of the body 202 of the drill bit 100. The origin 220" of the secondary passageway 213' from the inlet 204 may be positioned at the distance 228, 232, 236 (see FIGS. 8-10) from the horizontal reference plane 216 or coincident with the reference point 220' (as shown in FIG. 1 and FIG. 7) on the horizontal reference plane 216.

In addition, the method includes a step 246 of determining a diameter of the drill bit 100, a step 248 of determining a velocity of the pressurized fluids through the secondary opening 214, and a step 250 of determining a pressure differential between a pressure of the pressurized fluids around the cutting surface 206 relative to a pressure of the pressurized fluids at the inlet 204. Lastly, the method a step 252 of reconfiguring the secondary opening 214 based on the diameter of the drill bit 100, the velocity and the pressure differential.

The step 242 of providing of the secondary opening 214 may be dependent on spatial positions of the plurality of inserts 218 provided on the cutting surface 206 of the drill bit 100. The secondary opening 214 may be positioned such that none of the plurality of the inserts 218 are in direct communication with pressurized fluids exiting from the secondary opening 214. For example, no insert 218 (see FIG. 3) is positioned in a region 225 (see FIGS. 3 and 4) that is immediately in front of the secondary opening 214.

The step 252 of reconfiguring the secondary opening 214 may include determining a diameter of the secondary opening 214. The step 252 may also include determining the total of circumferential areas of the two main openings 208, 208' and the circumferential areas of the two secondary openings 214, 214'. Further, the step 252 may include reconfiguring the angle 217, 226, 230, 234 (see FIG. 1 and FIGS. 7-10) of the secondary opening 214 with respect to the horizontal reference plane 216. In addition, the step 252 may include reconfiguring the distance 228, 232, 236 (see FIGS. 8-10) of the origin 220" of the secondary passageway 214 from the horizontal reference plane 216. The diameter of the secondary passageway 214, the total of the circumferential areas, the angle 217, 226, 230, 234 of the secondary passageway 214, and the distance 228, 232, 236 is empirically determined and reconfigured in step 252 in order to improve efficiency and the lifespan of the drill bit 100.

The step 238 of providing the inlet 204 in the body 202 of the drill bit 100, the step 240 of providing the main opening 208 and the step 242 of providing the secondary opening 214 may involve one or more machining processes such as, but not limited to, drilling, reaming, boring, tapping, counter-boring, and counter-sinking during fabrication or manufacture of the drill bit 100.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A drill bit, comprising:

a body adapted to flush cut matter from a bore hole, the body defining a flushing system, the flushing system including:

an inlet to facilitate supply of pressurized fluids to flush the cut matter from the bore hole;

a cutting surface provided with at least one main opening that is in communication with the inlet, wherein the at least one main opening allows passing of the pressurized fluids from the inlet to the bore hole and defines a main passageway originating from the inlet to the cutting surface; and a peripheral surface, surrounding the cutting surface, provided with at least one secondary opening that is in communication with the inlet, wherein the at least one secondary opening allows passing of the pressurized fluids from the inlet to the bore hole and defines a secondary passageway originating from the inlet to the peripheral surface, the secondary passageway being disposed at an acute angle with respect to a horizontal reference plane that is defined between the inlet and the origin of the main passageway and is perpendicular to a central longitudinal axis of the body, the origin of the secondary passageway being positioned at a distance from the horizontal reference plane, an edge defining a corner forms an interface between the cutting surface and the peripheral surface, a plurality of inserts are positioned on the cutting surface and a position of the at least one secondary opening on the peripheral surface is determined by the positioning of the plurality of inserts on the cutting surface, none of the inserts are positioned at a portion of the edge between the at least one secondary opening and a region on the cutting surface in front of said portion of the edge and said at least one secondary opening in a direction from said at least one secondary opening toward said portion and said region on the cutting surface, and none of the inserts are positioned in said region.

2. The drill bit of claim 1, wherein the origin of the at least one secondary passageway precedes the origin of the at least one main passageway from the inlet.

3. The drill bit of claim 1, wherein the origin of the at least one main passageway precedes the origin of the at least one secondary passageway from the inlet.

4. The drill bit of claim 1, wherein the cutting surface is provided with two main openings of the at least one main opening, the two main openings independently defining two main passageways originating from the inlet and disposed at an angle from the central longitudinal axis of the drill bit.

5. The drill bit of claim 4, wherein the horizontal reference plane is defined at an outer neck surface of the body that is perpendicular to the central longitudinal axis.

6. The drill bit of claim 5, wherein the two secondary openings are diametrically similar.

7. The drill bit of claim 5, wherein the two secondary openings are diametrically dissimilar.

8. The drill bit of claim 1, wherein the peripheral surface is provided with two secondary openings of the at least one secondary opening, the two secondary openings independently defining two secondary passageways originating from the inlet disposed at an angle from the central longitudinal axis of the drill bit.

9. The drill bit of claim 1, wherein the peripheral surface includes a plurality of longitudinal slots and the at least one secondary opening is provided in one of the plurality of the longitudinal slots.

10. The drill bit of claim 1, wherein the angle of the at least one secondary passageway with respect to the horizontal reference plane ranges from 37 degrees to 43 degrees.

11. The drill bit of claim 1, wherein the inlet defines a recess having one of a hemispherical shape, a semi-elliptical shape, a flanged shape, a dished shape, a cone shape, and a flat shape at the origin of the at least one main passageway.

12. The drill bit of claim 1, wherein an intersection of a central longitudinal axis of the at least one main passageway with the central longitudinal axis defines the origin of the at least one main passageway and an intersection of a central longitudinal axis of the at least one secondary passageway with the central longitudinal axis defines the origin of the at least one secondary passageway.

13. A method for configuring a drill bit to flush cut matter from a bore hole, the method comprising:

providing an inlet in a body of the drill bit to facilitate supply of pressurized fluids to the bore hole;

providing at least one main opening in a cutting surface that is in communication with the inlet, wherein the at least one main opening defines a main passageway originating from the inlet to the cutting surface;

providing at least one secondary opening, in a peripheral surface surrounding the cutting surface, that is in communication with the inlet, wherein the at least one secondary opening defines a secondary passageway originating from the inlet to the peripheral surface, the secondary passageway being disposed at an angle with respect to a horizontal reference plane that is defined between the inlet and the origin of the main passageway and is perpendicular to a central longitudinal axis of the body, and the origin of the secondary passageway from the inlet being positioned at a distance from the horizontal reference plane;

determining a diameter of the drill bit;

determining velocity of the pressurized fluids through the at least one secondary opening;

determining a pressure differential between a pressure of the pressurized fluids around the cutting surface relative to a pressure of the pressurized fluids at the inlet; and reconfiguring the secondary opening based on the diameter of the drill bit, the velocity and the pressure differential.

14. The method of claim 13, wherein the reconfiguring of the at least one secondary opening includes:

determining a diameter of the at least one secondary passageway;

determining a total of a circumferential area of the at least one main opening and a circumferential area of the at least one secondary opening;

reconfiguring the angle of the at least one secondary passageway with respect to the horizontal reference plane; and reconfiguring the distance of the origin of the at least one secondary passageway from the horizontal reference plane.

15. The method of claim 14, wherein the diameter, the total circumferential area, the angle, and the distance are empirically determined and reconfigured respectively to improve efficiency and a total lifespan of the drill bit.

16. The method of claim 15, wherein a total of circumferential areas of the two main openings and circumferential areas of the two secondary openings is equivalent to a total of circumferential areas of three main openings of the at least one main opening.

17. The method of claim 13, wherein the drill bit is configured with two main openings of the at least one main opening and two secondary openings of the at least one secondary opening.

18. The method of claim 13, wherein the providing of the at least one secondary opening is dependent on spatial positions of a plurality of inserts provided on the cutting surface such that none of the plurality of inserts are in direct communication with the pressurized fluids exiting from the at least one secondary opening.

* * * * *